US006074161A

United States Patent [19]

Gurtner

[11] Patent Number: 6,074,161

[45] Date of Patent: Jun. 13, 2000

[54] APPARATUS FOR PUSHING OUT STACKED SIGNATURES

[75] Inventor: Stephan Gurtner, Oftringen, Switzerland

[73] Assignee: Grapha-Holding AG, Hergiswil, Switzerland

[21] Appl. No.: 08/927,482

[22] Filed: Sep. 11, 1997

[30] Foreign Application Priority Data

Sep. 11, 1996 [CH] Switzerland ..... 2219/96

[51] Int. Cl.[7] ..... B65G 57/06

[52] U.S. Cl. ..... 414/790.3; 414/789.9; 414/903

[58] Field of Search ..... 414/789.9, 788.9, 414/788.1, 790.3, 903; 74/23, 24, 25

[56] References Cited

U.S. PATENT DOCUMENTS

| | | | |
|---|---|---|---|
| 3,260,191 | 7/1966 | Pierson et al. | 100/4 |
| 3,595,370 | 7/1971 | Fujishiro | 414/790.3 |
| 4,708,561 | 11/1987 | Merkli et al. | 414/790.3 |
| 4,725,180 | 2/1988 | Kasamatsu et al. | 414/790.3 |
| 4,992,016 | 2/1991 | Ferloni | 414/789.9 |
| 5,116,195 | 5/1992 | Pattarozzi | 414/789.9 |
| 5,234,306 | 8/1993 | Yamashita | 414/789.9 |
| 5,392,700 | 2/1995 | Kleinhen | 414/790.3 |
| 5,628,614 | 5/1997 | Pazdernik et al. | 414/790.3 |

FOREIGN PATENT DOCUMENTS

| | | |
|---|---|---|
| 0 057 894 A1 | 2/1982 | European Pat. Off. . |
| 0 626 330 A2 | 3/1994 | European Pat. Off. . |
| 19 36 371 | 7/1968 | Germany . |

*Primary Examiner*—Douglas A. Hess
*Attorney, Agent, or Firm*—Venable; Robert Kinberg; Catherine M. Voorhees

[57] ABSTRACT

An apparatus for pushing out stacked signatures includes a table on which the signatures are placed in a stack. A push-out element is seated above the table in a lever gear so as to be rotatable on a closed path for being applied to the stack in a push-out movement pushing the stack away from the table.

7 Claims, 4 Drawing Sheets

APPARATUS FOR PUSHING OUT STACKED SIGNATURES

CROSS-REFERENCE TO RELATED APPLICATIONS

This application claims priority of Swiss application No. CH 19962219/96, filed in Switzerland on Sep. 11, 1996, the disclosure of which is incorporated herein by reference.

BACKGROUND OF THE INVENTION

The invention relates to an apparatus for pushing out stacked signatures, the apparatus having a table on which the signatures are to be stacked and having at least one push-out element which can be applied to a stack that is disposed on the table and with which the stack can be pushed away from the table.

Apparatuses of the type mentioned are known in so-called stackers or crosswise stackers and are designed to push stacked and compressed signatures away from a turntable of a stacker arrangement. In a known arrangement, a pneumatically controlled rod is integrated in the turntable for this purpose, the rod forming a so-called pusher. To push out a stack, the rod executes vertical and linear horizontal movements. During the vertical movements, the rod is lifted out of a recessed position into a position which projects beyond the turntable and is again recessed in the turntable after a horizontal movement. During the horizontal movement, the projecting rod is applied to the stack and the stack is pushed away from the table. The stack can be pushed out towards the left, towards the right or in an alternating manner. During this process, it is not possible to avoid an additional idle stroke.

The drawback of the known apparatus is that a push-out speed of approximately 1.2 m/sec. cannot be exceeded. At higher speeds, the pneumatically controlled rod executes an abrupt movement upon the stack which raises a risk that the stack tips over or that the signatures are damaged. This could be improved, per se, by way of a more complex pneumatic control, but this would be costly.

SUMMARY OF THE INVENTION

It is an object of the invention to provide an apparatus of the above-described type which permits a significantly higher output and which can be produced economically and still have a reliable operation.

The above and other objects are accomplished according the invention by the provision of an apparatus for pushing out stacked signatures, comprising: a table on which the signatures are placed in a stack; a lever gear; and a push-out element seated above the table in the lever gear so as to be rotatable on a closed path for being applied to the stack in a push-out movement pushing the stack away from the table.

In the apparatus according to the invention, the push-out element can be moved continuously and it can, for example, be actuated freely by a servomotor. A continuous, servomotor-controlled movement of the push-out element is not only wear-preserving and gentle, but also can be reliably controlled at a high speed. Thus, push-out speeds of, for example, 3 m/sec are possible. It is also essential that the drive and the lever gear can be controlled in a manner entirely free from the turntable. In addition, the lever gear permits a space-saving accommodation above a stack shaft.

Preferably, two or more push-out elements are provided, which alternatingly push out respectively one stack. If two push-out elements are provided which are arranged diametrically opposite one another relative to a joint pivot axis, the one push-out element is ready again for a further push-out movement after a stack has been pushed out by the other push-out element. This permits a particularly high output.

According to a modification of the invention, a particularly straightforward but, nevertheless, reliable embodiment of the lever gear is provided wherein the push-out element is mounted on a horizontally extending arm which is displaceable on a pivotally driven member.

If two push-out elements are included, a modification of the invention provides that two arms are alternately guided in a cam track and these two arms are, for example, displaceably connected to one another by means of a pinion disposed between the arms. Because of the coupling of the two arms, it suffices if respectively only one arm is guided in the cam track. This permits considerable simplifications in terms of construction and a space-saving design. Further advantageous modifications and features will become apparent from the ensuing description when considered in conjunction with the accompanying drawings.

BRIEF DESCRIPTION OF THE DRAWINGS

In the following, an embodiment of the invention is explained in greater detail by way of the drawings, wherein.

DETAILED DESCRIPTION OF THE INVENTION

Figure 1:
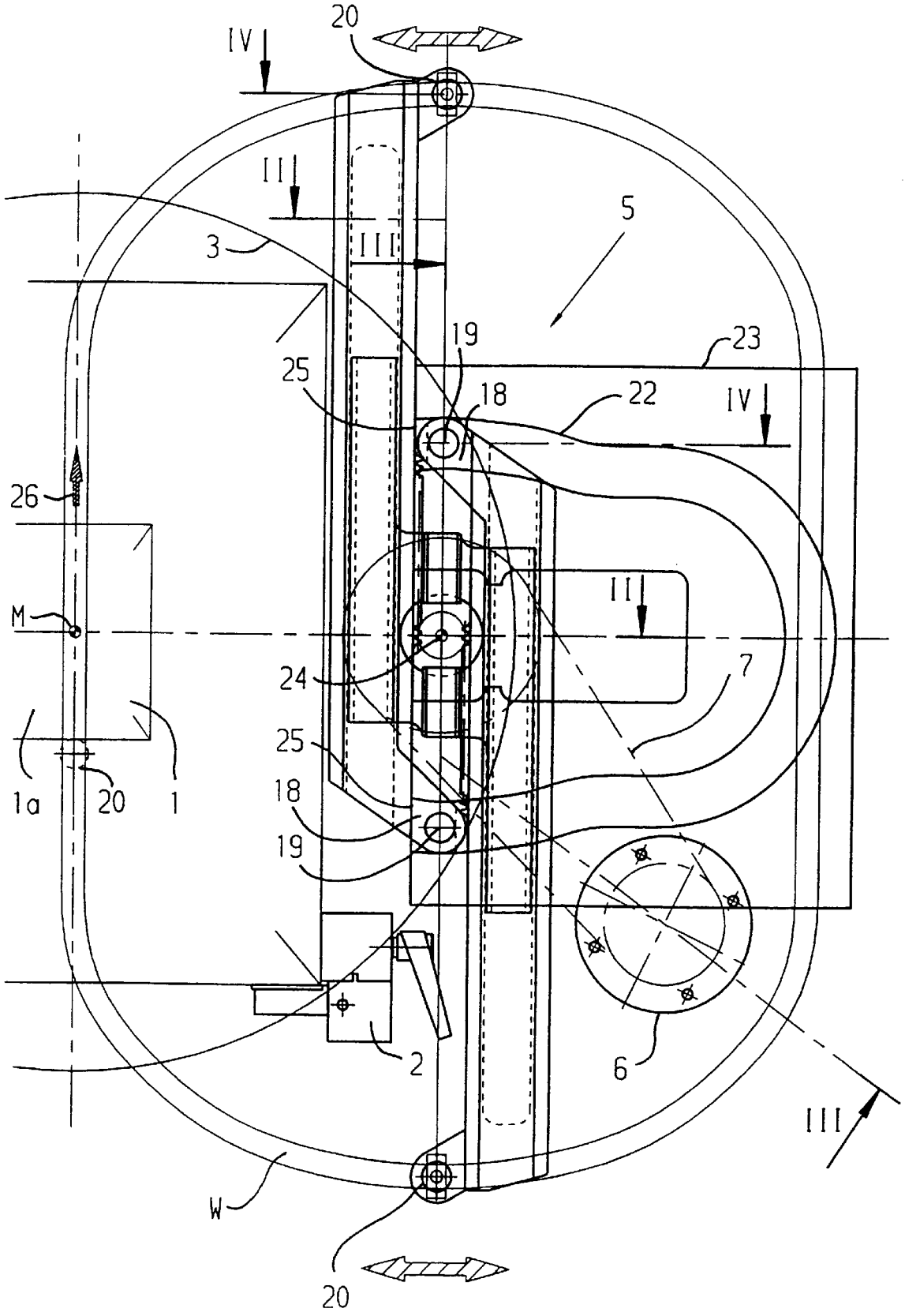
FIG. 1 is a plan view of the apparatus according to the invention, wherein housing components are omitted for better visibility.

Referring to FIG. 1, there is shown an apparatus according to the invention which includes a turntable 3 rotatable around a vertical pivot axis M for a crosswise stacking of signatures 1*a*. Signatures la are fed in a known manner to turntable 3 in a known stack shaft, not shown here, to form a stack 1 of pressed together signatures. A displaceable stop 2 is arranged above the turntable 3 and permits the stacking of signatures 1*a* of different formats.

Figure 7:
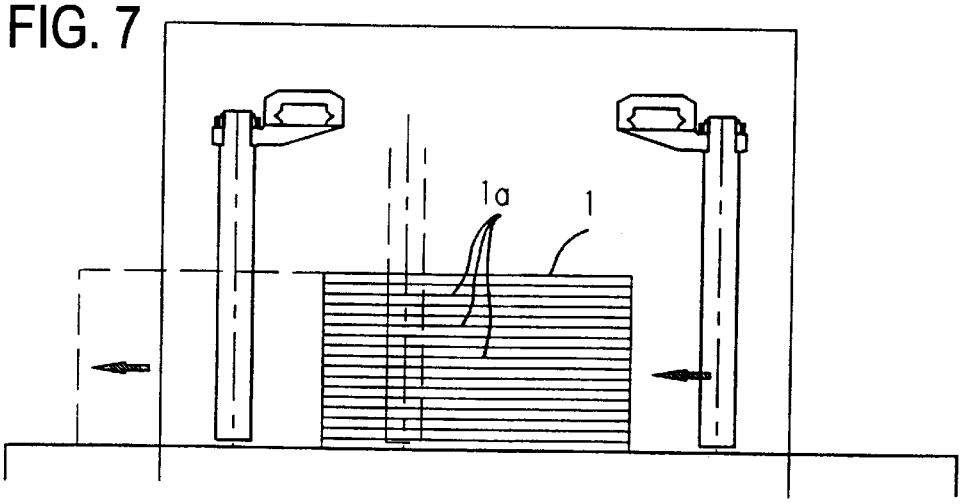
FIGS. 7 and 8 are schematic views of the apparatuses according to the invention.

Above turntable 3 and at a distance from the same, a lever gear 5 is arranged which is designed to push out stack 1 in FIG. 1 toward the top or toward the bottom of the drawing sheet, or alternatingly in these directions and to thus feed the stack to a further installation, not shown here. FIG. 7 schematically illustrates a stack 1 that is being pushed out to the left. The lever gear 5 is housed above stack 1 in a box-shaped frame 4.

Figure 8:
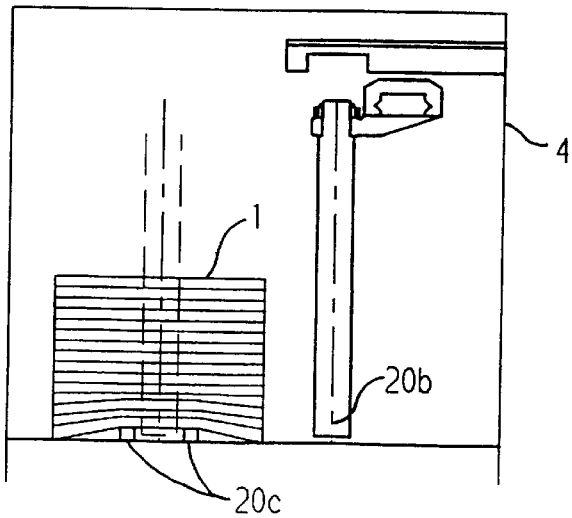

For pushing out stack 1, lever gear 5 has two vertically extending rods 20 which are diametrically opposite one another relative to a pivot axis 24, the rods each constituting a push-out element. These rods 20 are each fixedly attached at an upper end 20*a* to an arm 15 (see, also, FIG. 4) and they move on an endless or closed path W as shown in FIG. 1. A section W' of the path W extends linearly, namely where stack 1 that is to be pushed out is disposed. Each rod 20 has a free bottom end 20*b* (see FIG. 8) which passes over the table 3 between two elevations, for example, ledges or bars 20*c*, so that a bottom one of the signature la of stack 1 can definitely still be grasped. In the following, a control of rods 20 is explained in greater detail.

Figure 4:
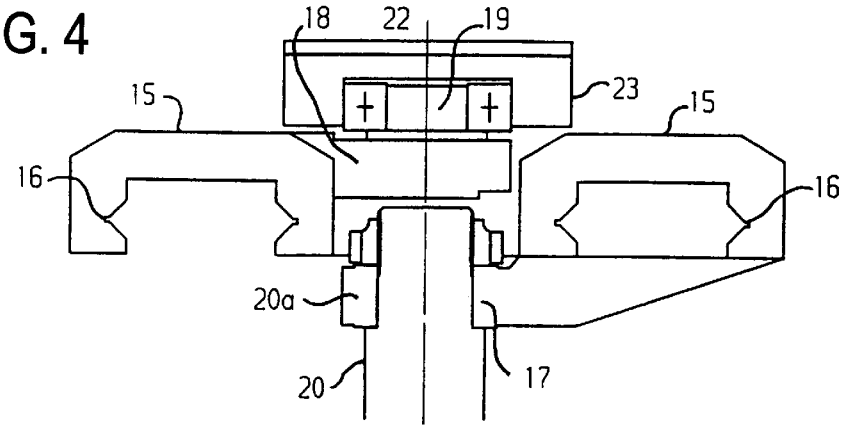
FIG. 4 is a section along the line IV—IV of FIG. 1.

According to FIG. 4, the two rods 20 are respectively secured to a laterally projecting attachment 20*a* of an arm 15. At an oppositely disposed end, a roller 19 is seated on each arm 15 on an also laterally projecting attachment 18.

According to FIG. 4, roller 19 engages a cam track 22 of a horizontal plate 23. The course of cam track 22 is illustrated in FIG. 1. Cam track 22 is approximately U-shaped and is open at two ends 25.

Figure 2:
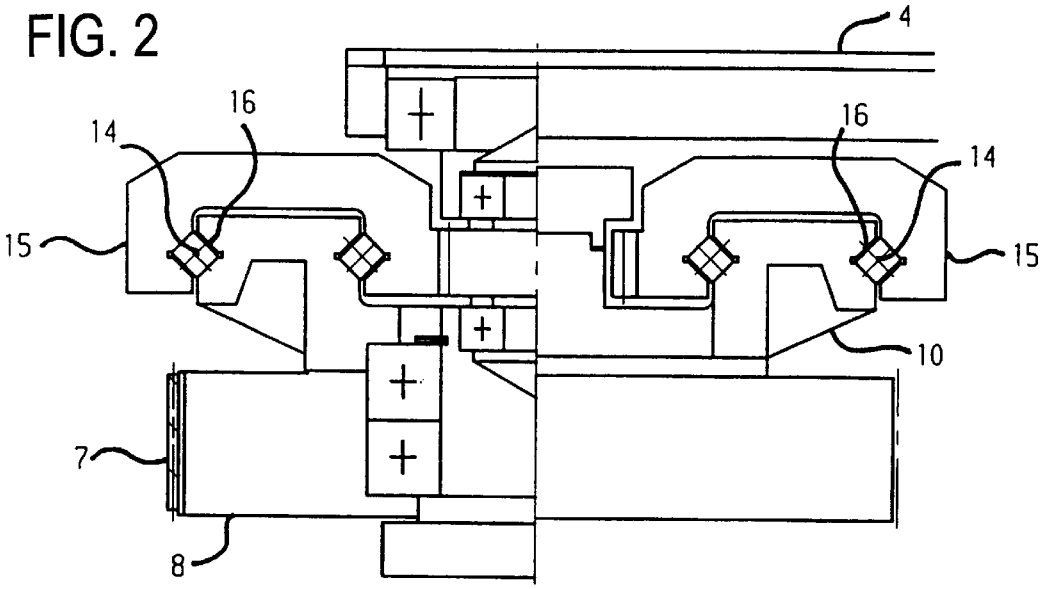
FIG. 2 is a section along the line II—II of FIG. 1.
Figure 6:
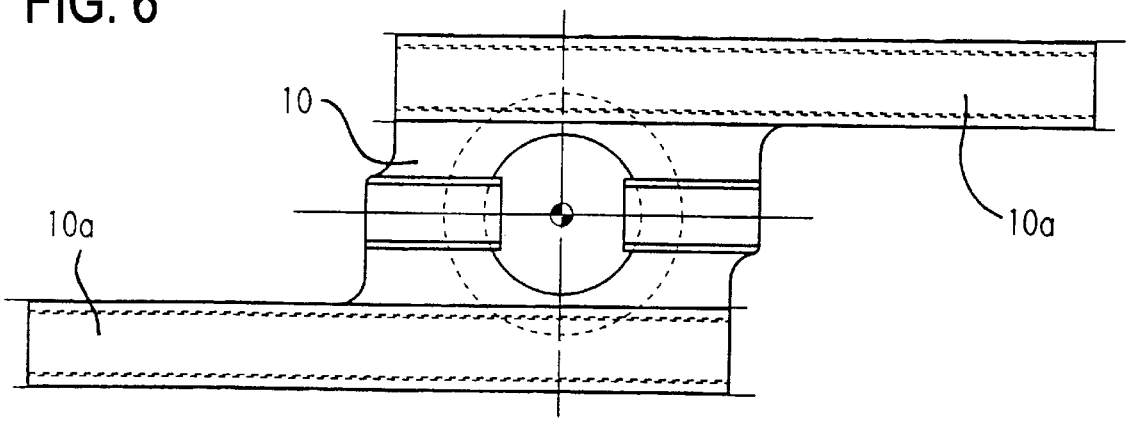
FIG. 6 is a view of a portion of FIG. 1.

The two arms 15 are seated on a pivoted member 10 (FIG. 6) so as to be parallel and displaceable counter to one another. According to FIG. 6, this approximately Z-shaped pivoted member 10 has two attachments 10*a* on top of which respectively one arm 15 is mounted. According to FIG. 2, each attachment 10*a* is respectively provided with a bearing 14 which is placed into a guiding groove 16 of the corresponding arm 15. The pivoted member 10 thus supports both arms 15 and permits the mentioned parallel and horizontal, as well as synchronous, displacement of the two arms 15.

Figure 3:
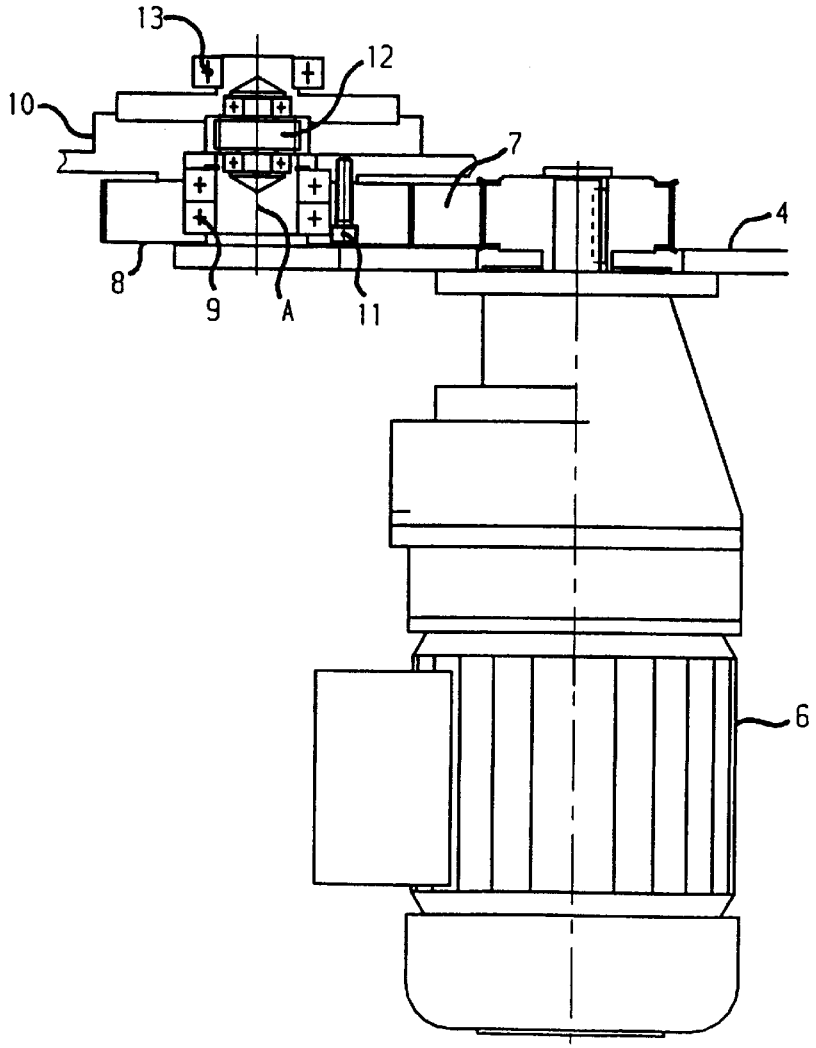
FIG. 3 is a section along the line III—III of FIG. 1 as well as a schematic view of the drive motor.
Figure 5:
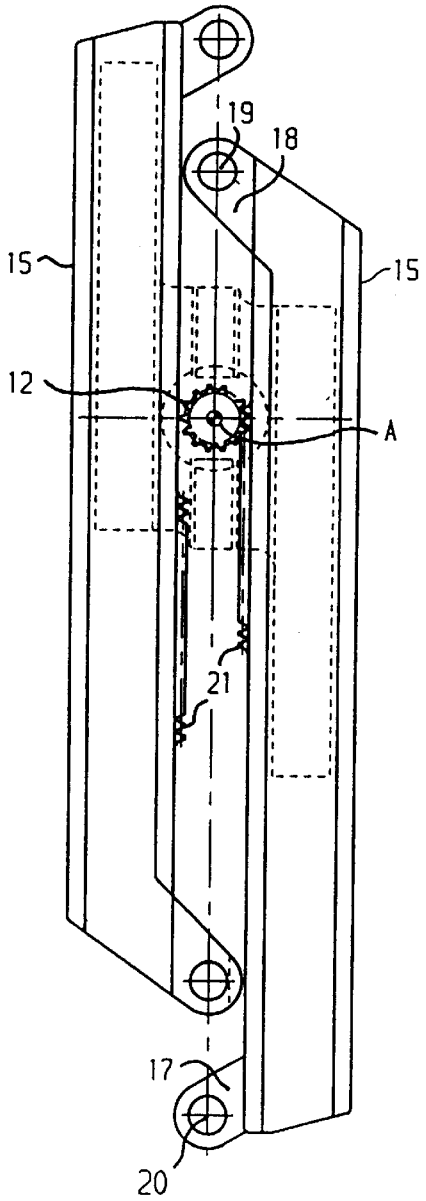
FIG. 5 is schematic views of portions of the apparatus according to FIG. 1.

According to FIGS. 3 and 5, a pinion 12 is seated with bearings 9 and 13 between the two arms 15 so as to be fixedly attached to the frame and coaxial with respect to axis A of pivoted member 10. Pinion 12 meshes with toothings 21 of the two arms 15. Therewith, a displacement of the one arm 15 inevitably effects an identical but oppositely directed displacement of the other arm 15.

According to FIG. 3, a wheel 8 is mounted on the underside of pivoted member 10 by screws 11. Wheel 8 is rotatably seated on frame 4 and connected as a drive to a motor 6 by way of a toothed belt 7. Motor 6 preferably is a servomotor and permits a controlled rotational movement of pivoted member 10 in the two directions of rotation.

When pivoted member 10 is driven by motor 6, the two arms 15 co-rotate in the same direction. If the arms 15 are now turned clockwise in FIG. 1, the rod 20 that is shown on the top moves toward the right and the arm 20 that is shown on the bottom moves toward the left. During this process, guide roller 19, arranged above (in the plane of the drawing) the pivot axis 24, enters cam track 22, whereas the other guide roller 19 leaves cam track 22. Based on the position shown in FIG. 1, only guide roller 19 that has entered cam track 22 is now in engagement with cam track 22 during a rotation through 180°. This means that only arm 15 that is shown at the right in FIG. 1 is directly controlled by cam track 22. The engagement of pinion 12 (see FIG. 5) at the two arms 15 now has the effect that the other arm 15 executes identical but oppositely directed, as well as synchronous, movements. Analogously, if the movement is counterclockwise, the other arm 15 is directly controlled by cam track 22. If, in the course of a movement in the clockwise direction, rod 20 that is shown at the bottom right in FIG. 1 has reached the position shown in dashed lines, the rod rests against stack 1. During the continuous progression of the movement, stack 1 is now displaced towards the top of the drawing in the direction of arrow 26 and ultimately leaves turntable 3. The rod 20 that is effecting the push-out movement also leaves turntable 3 and moves away from turntable 3 on path W, whereas in FIG. 1 the other rod 20 approaches turntable 3 and a newly formed stack 1 from the bottom of the drawing. A newly formed stack 1 is now pushed out by the subsequent rod 20. Of course, a counter-clockwise movement is also possible. Finally, motor 6 can also be controlled such that the two rods 20 are moved around alternatingly, clockwise and counter-clockwise. Preferably, the rotating movement is continuous, but the speed can be changed without difficulty. For example, a deceleration of the speed might be advisable when a rod 20 is applied to stack 1. This makes it possible that the stack is pushed out in a particularly gentle manner. After a stack has been pushed out, the rotational speed can be increased again. The control of the speed can be adjusted to the type of signatures la and also, for example, to the height and the weight of the stack 1. Thus, each stack 1 can be pushed out at the greatest possible speed.

The invention has been described in detail with respect to preferred embodiments, and it will now be apparent from the foregoing to those skilled in the art that changes and modifications may be made without departing from the invention in its broader aspects, and the invention, therefore, as defined in the appended claims is intended to cover all such changes and modifications as fall within the true spirit of the invention.

What is claimed is:

1. An apparatus for pushing out stacked signatures, comprising:

a table on which the signatures are placed in a stack, said table being in a horizontal position;

a lever gear including a pivotably driven member having a pivot axis and a horizontal extending arm, said horizontal extending arm being attached to said pivotably driven member and pivoting around said pivot axis; and a push-out element including a rod, an upper end of said rod being attached to said horizontally extending arm wherein the push-out element is seated above the table in the lever gear so as to be rotatable on a closed path for applying a push-out movement to the stack thereby pushing the stack away from the table, said closed path having a linear displacement section which is associated with the push-out movement of the stack.

2. The apparatus according to claim 1, wherein the closed path extends in a horizontal plane.

3. The apparatus according to claim 1, wherein the lever gear further includes a cam track and the horizontally extending arm is guided in the cam track at a distance from the push-out element.

4. The apparatus according to claim 3, wherein the push-out element further comprises two push-out elements and the lever gear includes two horizontally extending arms each of which mounts a respective one of the two push-out elements.

5. The apparatus according to claim 4, wherein the two horizontally extending arms are arranged to be alternatingly guided in the cam track and the lever gear further includes a pinion disposed between the two horizontally extending arms so that the two horizontally extending arms are displaceably connected to one another.

6. The apparatus according to claim 4, wherein the lever gear has a joint pivot axis with respect to which the two push-out elements are arranged diametrically opposite one another relative to the joint pivot axes and are jointly pivoted.

7. An apparatus for pushing out stacked signatures, comprising:

a table on which the signatures are placed in a stack, said table being in a horizontal position;

a lever gear including a pivotably driven member, a horizontal extending arm and a cam track, said horizontal extending arm pivoting about the pivotably driven member; and a push-out element including a rod, an upper end of said rod being attached to said horizontally extending arm wherein the push-out element is seated above the table in the lever gear so as to be rotatable on a closed path having a linear displacement section for applying a push-out movement to the stack thereby pushing the stack away from the table, and wherein said pivoting horizontal extending arm is guided in the cam track at a distance from the push-out element.

* * * * *